US009808386B2

(12) United States Patent
Gentile et al.

(10) Patent No.: US 9,808,386 B2
(45) Date of Patent: Nov. 7, 2017

(54) SEAT SUPPORT

(71) Applicants: Amy Gentile, Georgetown, MA (US); Michael Gentile, Georgetown, MA (US)

(72) Inventors: Amy Gentile, Georgetown, MA (US); Michael Gentile, Georgetown, MA (US)

( * ) Notice: Subject to any disclaimer, the term of this patent is extended or adjusted under 35 U.S.C. 154(b) by 42 days.

(21) Appl. No.: 14/968,338

(22) Filed: Dec. 14, 2015

(65) Prior Publication Data

US 2016/0095771 A1 Apr. 7, 2016

Related U.S. Application Data

(63) Continuation-in-part of application No. 14/011,801, filed on Aug. 28, 2013, now Pat. No. 9,241,854.

(51) Int. Cl.

| | |
|---|---|
| ***A61G 5/14*** | (2006.01) |
| ***A61G 7/10*** | (2006.01) |
| ***A47C 7/54*** | (2006.01) |

(52) U.S. Cl.

CPC ..... *A61G 5/14* (2013.01); *A47C 7/546* (2013.01); *A61G 7/1038* (2013.01)

(58) Field of Classification Search

CPC .. A47C 1/16; A47C 4/02; A47C 7/546; B60N 2/4673

USPC ..... 297/252, 352, 440.24, 411.23, 411.26

See application file for complete search history.

(56) References Cited

U.S. PATENT DOCUMENTS

| | | | | | |
|---|---|---|---|---|---|
| 1,890,102 | A | * | 12/1932 | Urquhart | B60N 2/4673 297/411.23 |
| 2,137,312 | A | * | 11/1938 | Thompson | A47C 1/16 297/252 |
| D121,266 | S | * | 7/1940 | Archer | 297/250.1 |
| 2,480,310 | A | * | 8/1949 | Torrey | A47C 1/16 297/252 |
| 2,545,840 | A | * | 3/1951 | Browne | A47C 1/16 297/252 |
| 2,725,925 | A | * | 12/1955 | Sanderson | A47C 1/16 297/252 |
| 2,914,115 | A | * | 11/1959 | Cameron | A47C 1/16 297/248 |
| 2,968,338 | A | * | 1/1961 | Reese | A47D 1/004 108/11 |
| 3,354,893 | A | * | 11/1967 | Schmerl | A61H 3/04 135/67 |
| 3,405,411 | A | | 10/1968 | Brown et al. | |
| 3,639,929 | A | * | 2/1972 | Ichise | A47C 21/08 297/423.1 |
| 3,739,793 | A | * | 6/1973 | Wilson | A47K 17/026 135/67 |

(Continued)

FOREIGN PATENT DOCUMENTS

| | | |
|---|---|---|
| WO | 9856281 | 12/1998 |
| WO | 2006094341 | 9/2006 |
| WO | 2012088599 | 7/2012 |

*Primary Examiner* — David E Allred

(74) *Attorney, Agent, or Firm* — Lambert & Associates; Gary E. Lambert; David J. Connaughton, Jr.

(57) ABSTRACT

A seat support device is provided. The seat support is configured to receive a seat cushion and provide support to the cushion as well as providing two support handles above the cushion. The combination of these elements allows an elderly, disabled, or otherwise weakened person to easily rise from a seated to standing position.

17 Claims, 5 Drawing Sheets

(56) References Cited

U.S. PATENT DOCUMENTS 4,022,502 A * 5/1977 Smith ..... A47C 7/546 297/352
4,475,256 A * 10/1984 Hatala ..... A47K 3/122 248/231.21
4,520,515 A * 6/1985 Hatala ..... A47K 3/122 248/231.21
4,690,457 A * 9/1987 Poncy ..... A61G 5/14 297/337
4,922,560 A * 5/1990 Skibinski ..... A61G 7/1038 135/67
5,397,169 A * 3/1995 Willans ..... A61G 5/14 297/411.23
5,414,871 A 5/1995 Stevens
5,449,013 A * 9/1995 Landers ..... A61G 7/1038 135/67
5,466,044 A * 11/1995 Barley ..... B60N 2/2821 297/250.1
5,498,054 A * 3/1996 Tomlinson ..... A47C 4/03 297/16.2
5,528,777 A 6/1996 Arft
5,580,130 A * 12/1996 Williams ..... A47C 1/16 297/252
5,597,208 A * 1/1997 Bonutti ..... A47B 21/0371 248/118.5
5,722,716 A * 3/1998 Thomas ..... A47C 17/045 297/118
5,904,168 A * 5/1999 Alulyan ..... A61H 3/00 135/65
5,983,911 A * 11/1999 Steele ..... A61G 5/1094 135/66
6,050,644 A * 4/2000 Neal ..... A47C 7/546 297/411.24
6,062,648 A * 5/2000 Adler ..... A47C 4/02 297/42
6,244,285 B1 * 6/2001 Gamache ..... A47C 21/08 135/66
6,332,232 B1 * 12/2001 Neal ..... A61G 7/053 297/411.23
6,338,493 B1 * 1/2002 Wohlgemuth ..... A61G 5/00 135/66
6,349,423 B1 2/2002 Kelleher
6,352,306 B1 * 3/2002 Dreiling ..... A47C 1/16 297/252
6,715,161 B1 4/2004 Depoe, Jr.
6,857,138 B2 2/2005 Moser et al.
6,860,281 B1 * 3/2005 Clift ..... A61G 7/1038 135/66
7,066,536 B2 * 6/2006 Williams ..... B60N 2/2851 16/266
7,128,369 B2 * 10/2006 Boggs ..... A47C 1/14 297/188.01
7,240,377 B2 7/2007 Vanden Heuvel
7,540,568 B2 * 6/2009 Behrens ..... A47C 3/00 297/42
7,775,228 B2 * 8/2010 Clark ..... A61G 7/1038 135/66
7,862,122 B1 * 1/2011 Shammas ..... B60N 2/245 297/411.2
8,075,059 B2 * 12/2011 Kim ..... A47C 1/146 297/16.1
8,113,587 B1 * 2/2012 Zarinfar ..... A61G 5/08 297/337
8,402,572 B2 3/2013 Herasimtschuk
2003/0062757 A1 * 4/2003 Calvery ..... A47C 4/02 297/440.24
2004/0041453 A1 * 3/2004 Ellis ..... A47C 1/023 297/344.18
2005/0179304 A1 * 8/2005 Serhan ..... A47K 3/282 297/440.24
2006/0220428 A1 * 10/2006 Vestweber ..... A47C 1/16 297/252
2006/0250010 A1 * 11/2006 Jones ..... A47C 1/16 297/352

* cited by examiner

SEAT SUPPORT

BACKGROUND OF THE INVENTION

Field of the Invention

The present invention relates generally to seat support devices. More particularly, the present invention relates to a device that provides bi-lateral arm support as well as a firm seat support to people sitting on a chair, couch, or other seating apparatus.

Description of Related Art

Frequently, elderly people and people with low core or leg strength, face a challenge of getting up out of a seated position in a couch or chair. Indeed, many therapists spend a great deal of time trying to teach and help these people so that they can get out of their seated position comfortably and/or without injuring themselves. Many couches have only one arm support per seat and in some cases no arm supports. This makes it difficult for many to get up because they have nothing to brace themselves on. Further, many couches and chairs have bodies that defines seating areas that are low and soft. This further adds to the difficulty of rising from the seated position because they must rise further from seated to standing, and with less support from the soft seat.

Because of these issues, in the past, a number of inconvenient solutions have been used. One method of aiding in getting up from a seated position is for the person to place one hand on an arm rest and the other on the soft cushion. This method may work, but not all people in a weakened state have the strength for this method, and it can contribute to injury because of the need to use one arm instead of both. Another option is to have a family member or aid to pull the person up. This is inconvenient and these aids are not always around to help. Yet another option is a spring loaded seat or a seat lift. These may be helpful, but also can be dangerous and inconvenient if used improperly. Some solutions involve raising the couch seat such as risers or added pillows. This, as with other solutions, may help, but in many situations is uncomfortable and inconvenient. Still another option to aid in the weak or elderly is a stand frame that may extend partially under the couch. This helps greatly in getting up because it provides something to grab onto, however it can be extremely dangerous as a tripping hazard because it may get caught under one's feet. Further, the stand frame does not provide any seat support, so seat softness continues to be a challenge.

Therefore, what is needed is a device that may provide bi-lateral arm support and also make the seat reasonably firm.

SUMMARY OF THE INVENTION

The subject matter of this application may involve, in some cases, interrelated products, alternative solutions to a particular problem, and/or a plurality of different uses of a single system or article.

In one aspect, a seat support is provided. The seat support comprises a substantially rigid base sheet with two arm supports attached to opposite sides of the base sheet. The arm supports extend vertically away from the base sheet. Each arm support defines part of a cushion receiving region sized to receive a seat cushion. A bottom of the cushion receiving region is defined by the substantially rigid base sheet. Further, each arm support forms a support handle for a user to grasp when rising from a seated to standing position.

In another aspect, a seat support is provided. The seat support comprises a base sheet and two arm supports attached to opposite sides of the base sheet. Each arm support defining part of a cushion receiving region and having a support handle. A seat cushion is positioned within the cushion receiving region of each arm support and above a top surface of the base sheet.

In yet another aspect, a seat is provided. The seat comprises a seating area having a back and a bottom, a cushion positioned in the bottom. A seat support is positioned on the seat about the cushion. The seat support comprises a substantially rigid base sheet with two arm supports attached to opposite sides of the base sheet. Each arm support defining part of a cushion receiving region and a support handle. The seat support is positioned about the cushion by the cushion being received within the cushion receiving region with the base sheet being beneath the cushion.

DETAILED DESCRIPTION

Figure 1:
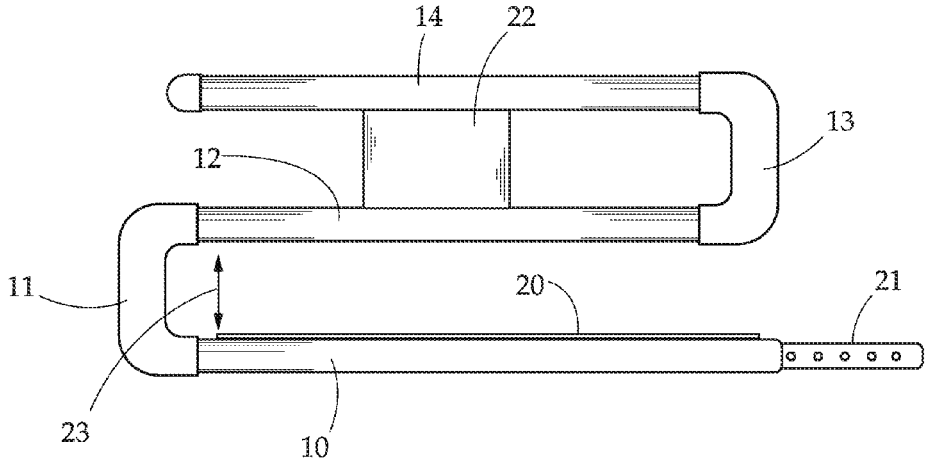
FIG. 1 provides a side view of an embodiment of an arm support of the present invention.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns two arm supports connected by a base sheet, with each of the two arm supports being sized and configured to receive a seat cushion, with the base sheet being positionable under the cushion. As such, the device may receive the cushion, and the cushion-device combination may be placed in the seat. The device thus provides support to the cushion as well as support handles to aid an elderly or weakened person in rising from the seated position.

The device contemplated herein may be formed in any manner capable such that the arm supports and base sheet may receive the couch cushion with the base sheet underneath the cushion and at least a portion of the arm supports on top of the cushion.

The arm supports contemplated herein may be formed of any material capable of receiving and holding the couch cushion that is strong enough to approximately retain its shape under the weight of a user while rising from a seated position. Examples of materials of which the arm supports may be made include, but are not limited to plastics, wood, composite materials, metals, and the like. In some embodiments, the arm supports may be made of a unitary construction, while in other embodiments, different materials pieces and shapes may be used.

The base sheet may be of any material capable of joining the first arm support to the second arm support. In some embodiments, the sheet may be a rigid sheet that provides a substantially rigid support of a cushion placed on top of it. The term substantially rigid is intended to mean something that is inflexible or only slightly flexible under the weight of an average person. In other embodiments, the sheet may be flexible, or partially flexible. Examples of materials of which the base sheet may be made include, but are not limited to: fabrics, plastic sheets, wood, metal sheets, composite materials, and the like.

In one embodiment, the sheet may be a solid and continuous rigid material such as plywood, hard plastic, or metal. In another embodiment, the sheet may be a grid such as a rigid grid of hard plastic, metal, or wood. In still another embodiment, the sheet may be formed as a plurality of strips extending between the two arm supports. In yet another embodiment, the rigid grid may have hinges or flexible connections between grid elements such that the grid may be collapsible, allowing the two arm supports to move towards each other in a collapsed position and extend away from each other in an extended position.

In one embodiment, the arm supports may be 'S' shaped. This S-shape may have curved edges, or sharply angled edges, or anything in between. A lower portion of the S shape being the cushion receiving region is sized to receive a seat cushion. Reception of the cushion may be by, for example, slidably receiving the cushion. In this embodiment, an upper portion, namely a top bar of the 'S' shape may be used as a support handle. The support handle can be grasped by a user for aiding in rising from the seated position. In some embodiments, the support handle may be reinforced by attachment to a central bar/shaft of the 'S' shape by, for example, a material connection between the top two horizontal portions of the 'S' shape. The material connection may be, among other things, a bar, plate, crossing support struts, or the like.

In one embodiment, the portion of arm supports forming the cushion receiving region may be formed of a thick material such as a tubing, bar, or the like. In this embodiment, the thickness of the material may serve to elevate the seat cushion by the thickness of the material. In one embodiment, the thickness may be between one inch and three inches. An advantage to an elevated seat is that a user has a shorter distance to travel to rise from a seated to standing position.

It should be understood that the arm supports may be in any shape capable of receiving a seat cushion that may also provide support handles. For example, the arm supports are not limited to an 'S' shape, and may be E-shaped, C-shaped, C-shaped with an extending arm support (shaped as a T, or any other extended arm support), or the like.

The two arm supports may be attached to the base sheet in any manner capable of supporting the seat cushion and allowing the arm supports to at least partially hold the weight of a person. In one embodiment, the arm supports may have a rigid connection to the base sheet such as a screw, nail, weld, glue, integral formation, or the like. In another embodiment, the arm supports may be rotatably attached to the base sheet by a hinge or the like. In a specific embodiment, the arm supports may be rotatable inwardly towards the base sheet, such that they may be folded down to a flat or nearly flat position. In still a further embodiment, the arm supports may be shaped such that they may fold inward without contacting each other, in that the arm supports may be slightly offset allowing both to fold inward to the base sheet.

In some embodiments, various elements of the arm supports may be adjustable to allow the arm supports to fit on various sized seating devices. For example, a length of the arm supports may be adjusted to fit longer cushions. Similarly, a height of the cushion receiving region of the arm supports may be adjustable to allow for thick or thin cushions. In some embodiments, the arm supports may also be adjustable in height and length depending on needs such as seating position, height, and the like.

Turning now to FIG. 1, a side view of an embodiment of an arm support of the present invention is provided. In this embodiment, the arm support is shown as generally S shaped, and formed of a plurality of different pieces (as opposed to a unitary arm support of other embodiments). A bottom shaft 10 connects to a first U-connector 11. A middle shaft 12 connects to the first U-connector 11 and the second U-connector 13. A top shaft 14 connects to the second U-connector. The middle shaft 12 and top shaft 14 are connected by support 22. The top portion of the 'S' shape, shown here as the top shaft 14 serves as the support handle for a user and therefore must be capable of supporting a weight from a person leaning on it while rising from a seated position. The support 22 aids in adding rigidity for the top shaft 14 support handle. Depending on material selection, the support 22 may not be required.

The embodiment of the arm support of FIG. 1 may be adjustable in both length and height. Telescoping shaft 21 is extendable into and out of bottom shaft 10 allowing the arm support to accommodate different sized cushions in the cushion receiving region 23. Similarly, U-shaped connector 11 may be extended in length to increase the height of cushion receiving region 23.

Figure 2:
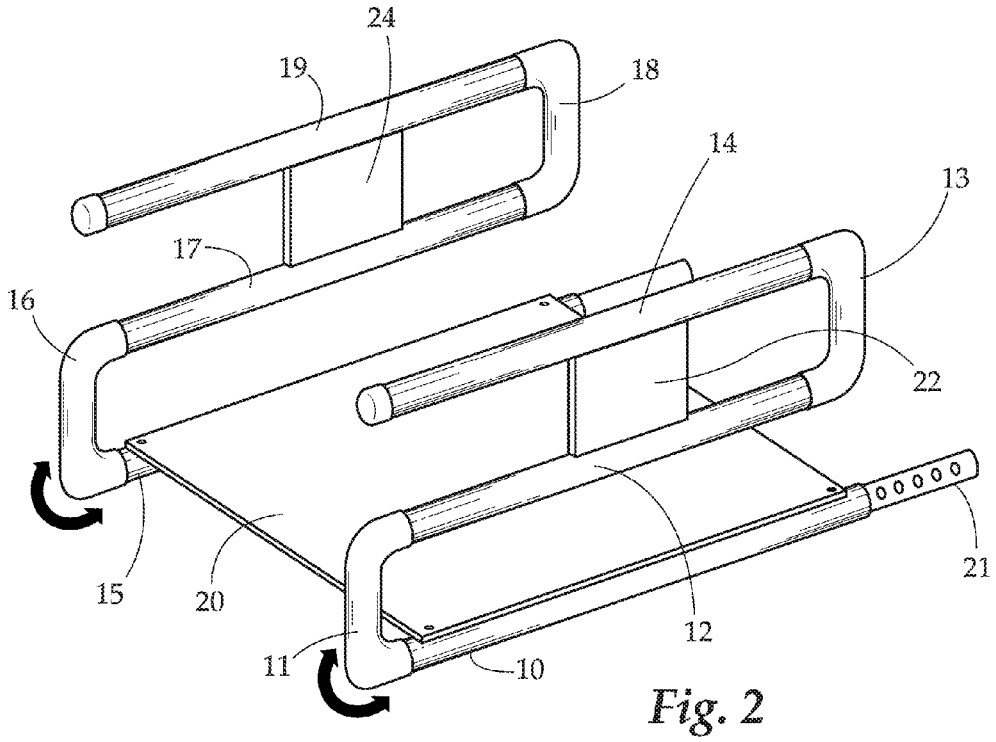
FIG. 2 provides a perspective view of an embodiment of the present invention.

FIG. 2 provides a perspective view of another embodiment of the seat support device. In this embodiment, the base sheet 20 as well as both arm supports can be seen. In this embodiment, both arm supports are substantially the same, each having a bottom shaft 10, 15 attached to a first U-shaped connector 11, 16. The bottom shafts 10, 15 are extendable in length by telescoping shafts 21, 22. A middle shaft 12, 17 is attached to the first U-shaped connector 11, 16, and the second U-shaped connector 13, 18. A top shaft 14, 19 extends from the second U-shaped connector 13, 18 and serves as the support handle. A support 22, 24 connects the top shafts 14, 19 and the middle shafts 12, 17. The bottom shafts 10, 15 are connected to the base sheet 20 at opposite ends of the base sheet 20. The base sheet 20, bottom shafts 10, 15, and middle shafts 12, 17, along with the U-shaped connectors 11, 16, define the cushion receiving region in which a seat cushion may be received. In some embodiments, these support arms may be pivotally attached to the base sheet, such that the device may be folded into a more compact shape.

Figure 3:
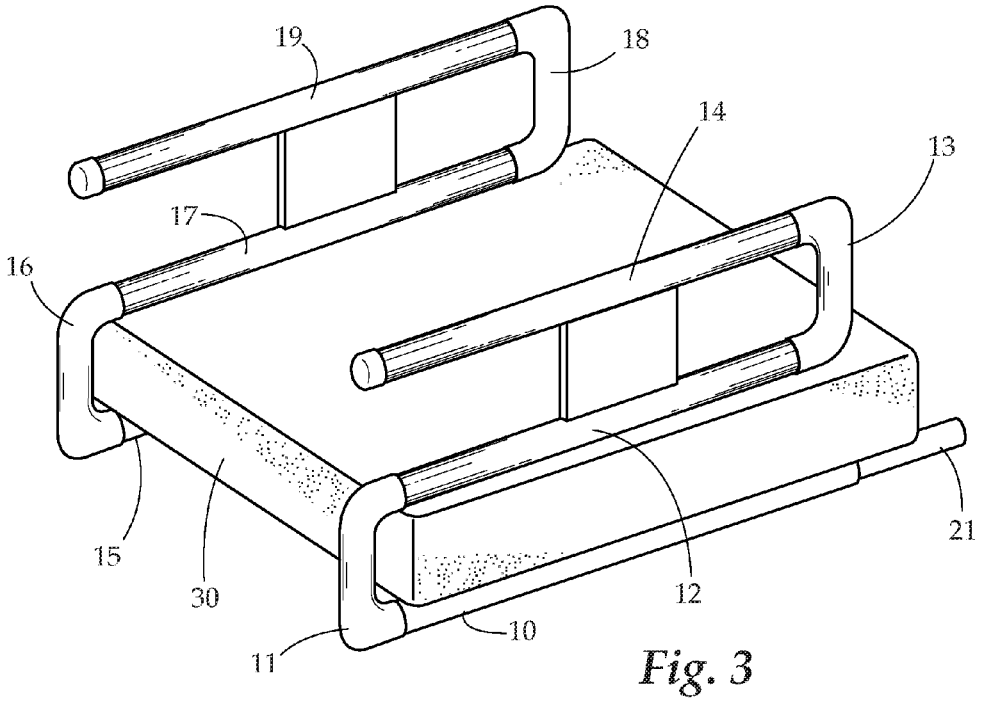
FIG. 3 provides a perspective view of another embodiment of the present invention.

FIG. 3 provides a perspective view of the seat support with a cushion positioned within the cushion receiving region.

In this embodiment, the bottom shafts, 10, 15, middle shafts 12, 17, and top shafts 14, 19 are connected in an S-shape by U connectors 11, 13, 16, 18. The lower and middle shafts, 10, 15, 12, 17, along with the base sheet (not shown) define the cushion receiving region in which the cushion 30 is positioned.

Figure 4:
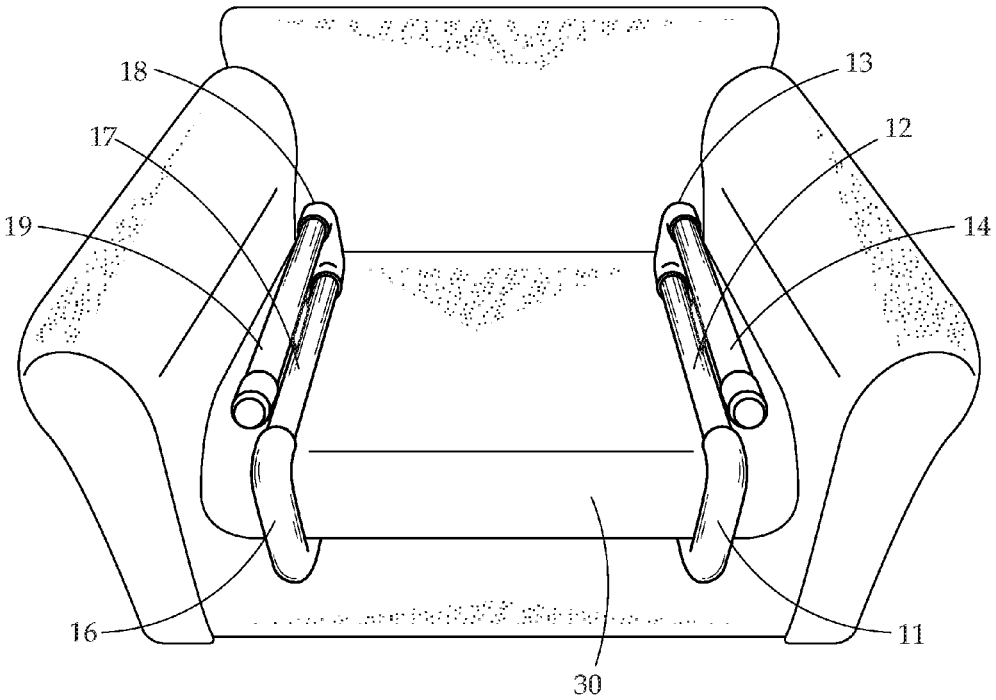
FIG. 4 provides a perspective view of an embodiment of the present invention in use.

FIG. 4 provides a view of the seat support in use. In this embodiment, a cushion is positioned within the cushion receiving region of the seat support. The cushion-seat support combination are positioned on a chair—thereby providing a cushion support as well as handles to aid in rising from a seated to standing position. In this embodiment, the bottom shafts, (not shown), middle shafts 12, 17, and top shafts 14, 19 are connected in an S-shape by U connectors 11, 13, 16, 18. The lower and middle shafts, 12, 17, along with the base sheet (not shown) define the cushion receiving region in which the cushion 30 is positioned. The cushion-seat support combination are together placed into the chair, making the chair now ready for a user who may need assistance moving from a seated to standing position.

Figure 5:
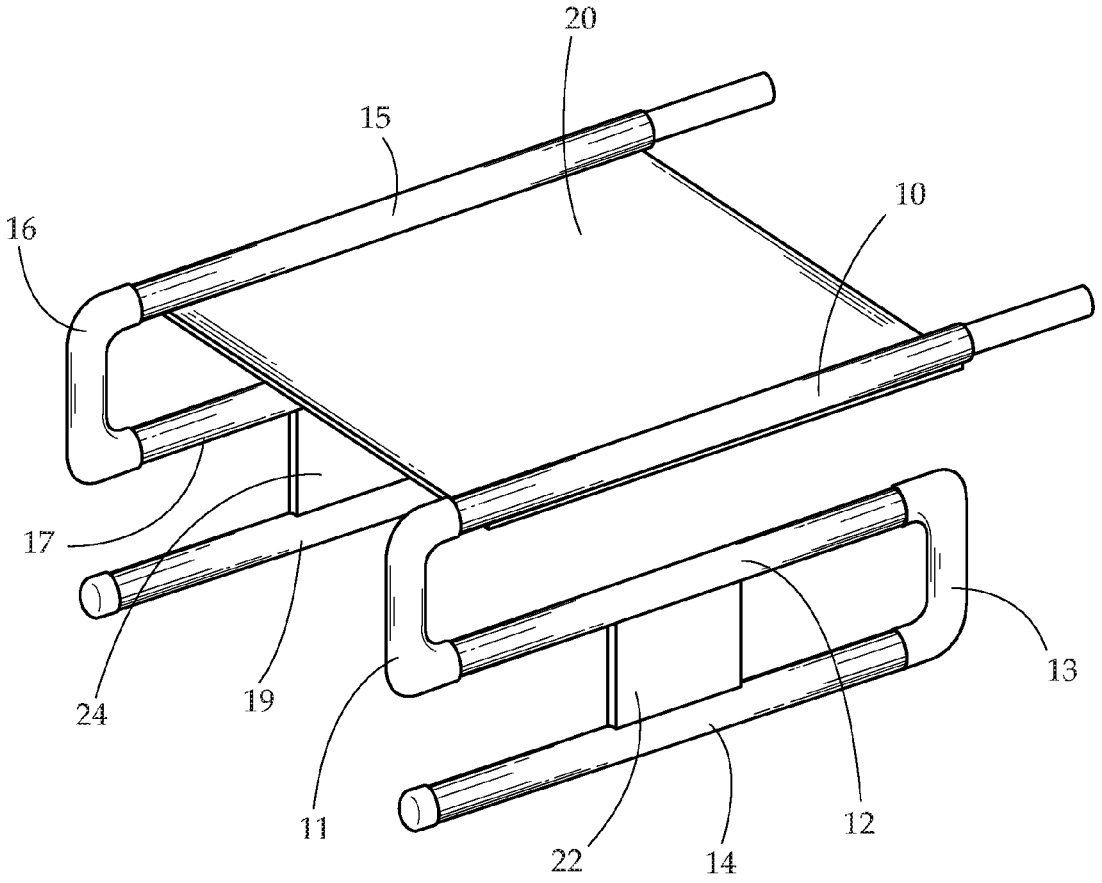
FIG. 5 provides a bottom perspective view of an embodiment of the present invention.

FIG. 5 shows another embodiment of a bottom perspective view of the device. In this embodiment, the connection of the base sheet 20 to the bottom shafts 10, 15 can be seen. However, it should be understood that the base sheet 20 may attach to the bottom shafts 10, 15 in any manner, including a rigid connection, hinged connection, or integrated together in a unitary construction. Further, it should be understood that while the base sheet 20 is shown as a solid sheet, in other embodiments the base sheet may have perforations in its surface.

Figure 6:
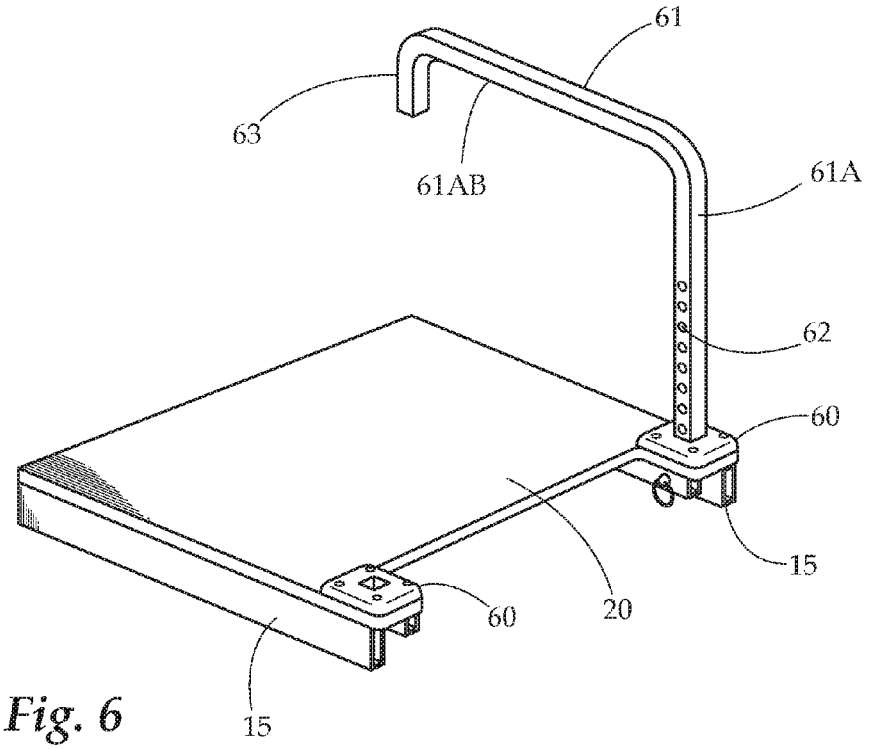
FIG. 6 provides a perspective view of another embodiment of the present invention.
Figure 7:
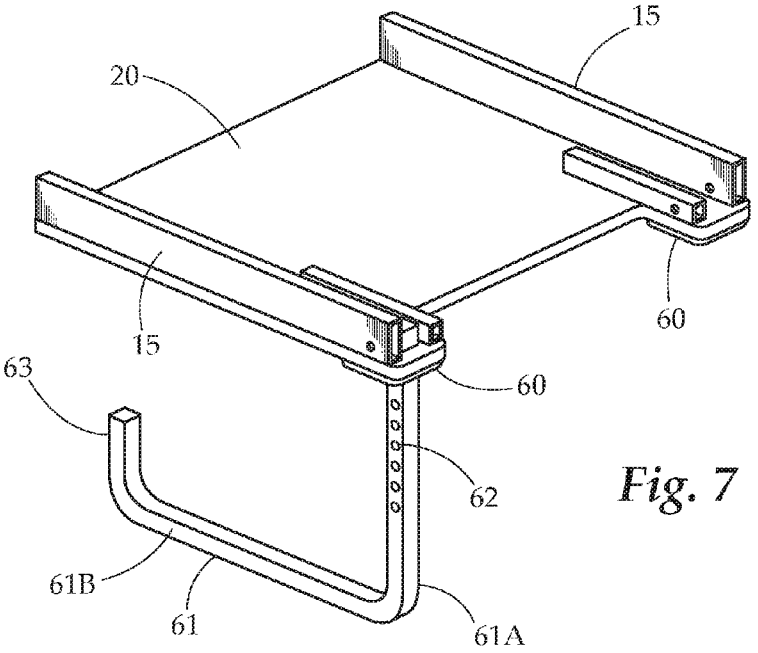
FIG. 7 provides a perspective view of yet an embodiment of the present invention.
Figure 8:
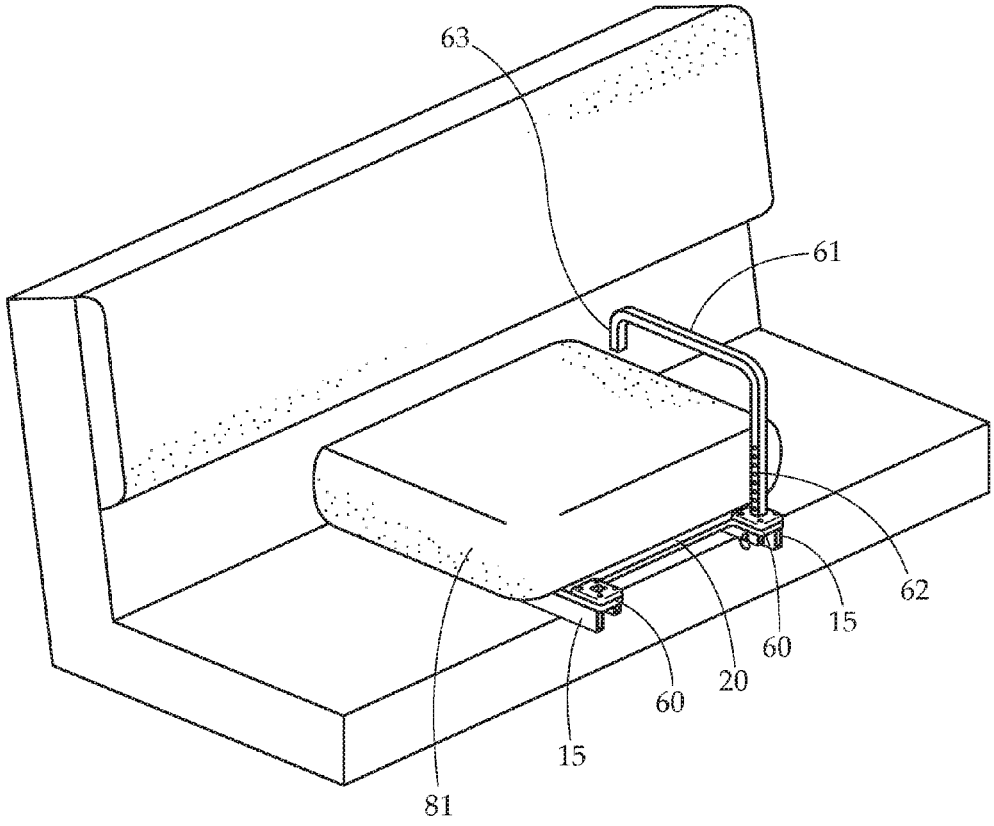
FIG. 8 provides a perspective view of still an embodiment of the present invention.

FIGS. 6-8 provide a view of another embedment of the present invention. In this view, the seat support has an arm support 61 extending away from the base sheet 20. This arm support 61 has a shape approximating an upside down J, with a first vertical portion 61*a* extending away from the base sheet approximately perpendicularly to the sheet (+/−15 degrees from perpendicular). The arm support vertical portion 61*a* then moves to a horizontal portion 61*b* approximately parallel to the base sheet (+/−15 degrees). On an end of the horizontal portion 61*b* on the opposite length of the seat support is a second vertical portion 63, which extends back downwardly towards the base sheet. As configured, the base sheet 20 and arm support 61 are configured to receive a seat cushion 81 such as a chair or couch cushion. The cushion 81 rests on a top of the seat support, and fits beneath the arm support 61. In some embodiments, the end of the second vertical portion 63 may contact and engage the seat cushion placed between it and the base sheet 20.

The base sheet 20 is formed of a rigid or substantially rigid material such as wood, metal, or hard plastic. In one embodiment, this base sheet 20 is sized to have a cross sectional footprint area greater than 50% of a cross sectional area of the seat cushion it is supporting. In another embodiment, the base sheet is sized to at least cover and reach a depth-wise (as in, front to back of the seat) center of the cushion. In such an embodiment, the base sheet is best able to prevent a sagging of the cushion, which occurs mostly at a center of the cushion.

The base sheet 20 has a thickness that both provides rigidity, and also elevates a seat cushion, such as a couch or chair cushion 81, placed on the base sheet underneath the horizontal portion 61*b* and second vertical portion 63. In addition to elevating the cushion, the rigidity of the base sheet 20 prevents a sagging of the cushion 81 at its center. The elevation and prevention of sagging greatly aids in allowing movement between the seated and standing position, because a seated person has a shorter distance to travel. The bottom shafts 15 on each end of the base sheet 20 are shown in this embodiment having a rectangular cross sectional shape. It should be understood, however, that the bottom shaft 15 may be any shape. The bottom shafts 15 are sized and formed of material that is rigid enough to not deform when sat on by a user. These bottom shafts 15 not only provide a support for the base sheet 20, but also elevate the cushion 81 further, working in conjunction with the base sheet to keep the cushion 81 from sagging or sinking, and somewhat elevated.

Accordingly, a height of the bottom shafts 15 elevates the cushion by that height.

In a particular embodiment, the base sheet 20 may have a thickness (height) approximately 0.5-5 cm, though it should be understood that the thickness may be greater or less without straying from the scope of the present invention. This allows the base sheet 20 to elevate the cushion by this amount off the bottom of the seat on which the cushion would normally rest. In a particular embodiment, the bottom shaft 15 may have a height of approximately 2-15 cm, though it should be understood that the thickness may be greater or less without straying from the scope of the present invention. This allows the bottom shaft 15 to elevate the cushion by this amount off the bottom of the seat on which the cushion would normally rest.

A plurality of holes 62 are formed along the vertical portion 61*a*. These holes allow for the arm support 61 to be attached to the slot 60 in the base sheet 20 in a plurality of different positions. It should be noted that two slots 60 are shown formed by and/or attached to the base sheet 20. In such a configuration an arm support 61 may be attached to one slot, or in each slot. A pin can pass through one of the plurality of holes 62 to hold the arm support 61 in place. In one embodiment, slot 60 may further be defined by bottom shaft 15, with the arm support being connected to the base sheet via the bottom shaft. In another embodiment, slot 60 may be formed as an opening in the base sheet 20. In still another embodiment, slot 60 may be formed by both the base sheet 20 and the bottom shaft 15.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A seat support comprising:

a substantially rigid base sheet;

at least one arm support comprising an elongate member, the at least one support attached to a lateral side of the base sheet, the elongate member bent to have portions extending longitudinally in a plurality of directions defining a rearward extending plane, and extending vertically away from the base sheet, the at least one arm support defining a cushion receiving region opening rearwardly in the rearward extending plane, and a support handle;

the at least one arm support having a first elongate vertical portion extending lengthwise approximately perpendicularly away from the base sheet, the vertical portion attached to the base sheet at a proximal end, an elongate horizontal portion extending lengthwise from a distal end of the vertical portion approximately parallel to the base sheet, the horizontal portion extending from a front of the base sheet towards a rear of the base sheet to form the support handle, a second elongate vertical portion of the at least one arm support extending downward at a distal end of the horizontal portion, the second vertical portion extending towards the base sheet approximately perpendicularly to the base sheet;

the substantially rigid base sheet having a cross sectional footprint area greater than 50% of a cross sectional area of a seat cushion placed within the cushion receiving region, and covering a center point of an area of the cushion receiving region;

wherein the substantially rigid base sheet further defines a bottom of the cushion receiving region and engages an underside of the cushion; and wherein the at least one arm support is connected to the base sheet by being secured in a slot with the first elongate vertical portion engaging a front face of the cushion.

2. The seat support of claim 1 wherein a distal end of the second vertical portion engages with the seat cushion.

3. The seat support of claim 1 wherein the at least one arm support comprises adjustable portions to adjust a connection of the at least one arm support to the base sheet.

4. The seat support of claim 1 wherein the at least one arm support is removably attached to the base sheet.

5. The seat support of claim 1 wherein the base sheet has a thickness of between 0.5-5 cm.

6. The seat support of claim 1 wherein a bottom shaft underlying the base sheet has a height of between 2-15 cm.

7. The seat support of claim 1 further comprising a second slot on an opposite lateral side from the slot, and further comprising a second arm support connected to the base sheet by the slot.

8. A couch comprising:

a body, the couch body forming an area for at least one person to sit on;

a couch cushion, the couch cushion covering at least a part of the area for the at least one person to sit on; and a seat support engaged with the couch cushion, the seat support comprising:

a substantially rigid base sheet;

at least one arm support, the at least one support attached to a lateral side of the base sheet, defining a rearward extending plane, and extending vertically away from the base sheet, the at least one arm support defining a cushion receiving region facing the rearward extending plane, and a support handle;

the at least one arm support having a first elongate vertical portion extending lengthwise approximately perpendicularly away from the base sheet, the vertical portion attached to the base sheet at a proximal end, an elongate horizontal portion extending lengthwise from a distal end of the vertical portion approximately parallel to the base sheet, the horizontal portion extending from a front of the base sheet towards a rear of the base sheet to form the support handle, a second elongate vertical portion of the at least one arm support extending downward at a distal end of the horizontal portion, the second vertical portion extending towards the base sheet approximately perpendicularly to the base sheet;

the substantially rigid base sheet having a cross sectional footprint area greater than 50% of a cross sectional area of the couch cushion placed within the cushion receiving region, and covering a center point of an area of the cushion receiving region;

wherein the substantially rigid base sheet further defines a bottom of the cushion receiving region and engages an underside of the cushion; and wherein the at least one arm support is connected to the base sheet by being secured in a slot with the first elongate vertical portion engaging a front face of the cushion.

9. The couch of claim 8 wherein a distal end of the second vertical portion engages with the seat cushion.

10. The couch of claim 8 wherein the base sheet has a thickness of between 0.5-5 cm.

11. The couch of claim 8 wherein a bottom shaft underlying the base sheet has a height of between 2-15 cm.

12. The couch of claim 8 further comprising a second slot on an opposite lateral side from the slot, and further comprising a second arm support connected to the base sheet by the slot.

13. A chair comprising:

a body, the chair body forming an area for a person to sit on;

a chair cushion, the chair cushion covering at least a part of the area for the person to sit on; and a seat support engaged with the chair cushion, the seat support comprising:

a substantially rigid base sheet;

at least one arm support comprising an elongate member, the at least one support attached to a lateral side of the base sheet, the elongate member bent to have portions extending longitudinally in a plurality of directions defining a rearward extending plane, and extending vertically away from the base sheet, the at least one arm support defining a cushion receiving region opening rearwardly in the rearward extending plane, and a support handle;

the at least one arm support having a first elongate vertical portion extending lengthwise approximately perpendicularly away from the base sheet, the vertical portion attached to the base sheet at a proximal end, an elongate horizontal portion extending lengthwise from a distal end of the vertical portion approximately parallel to the base sheet, the horizontal portion extending from a front of the base sheet towards a rear of the base sheet to form the support handle, a second elongate vertical portion of the at least one arm support extending downward at a distal end of the horizontal portion, the second vertical portion extending towards the base sheet approximately perpendicularly to the base sheet;

the substantially rigid base sheet having a cross sectional footprint area greater than 50% of a cross sectional area of the chair cushion placed within the cushion receiving region, and covering a center point of an area of the cushion receiving region;

wherein the substantially rigid base sheet further defines a bottom of the cushion receiving region and engages an underside of the cushion; and wherein the at least one arm support is connected to the base sheet by being secured in a slot with the first elongate vertical portion engaging a front face of the cushion.

14. The chair of claim 13 wherein a distal end of the second vertical portion engages with the seat cushion.

15. The chair of claim 13 wherein the base sheet has a thickness of between 0.5-5 cm.

16. The chair of claim 13 wherein a bottom shaft underlying the base sheet has a height of between 2-15 cm.

17. The chair of claim 13 further comprising a second slot on an opposite lateral side from the slot, and further comprising a second arm support connected to the base sheet by the slot.

* * * * *